US005662010A

United States Patent [19]

Barnett

[11] Patent Number: 5,662,010

[45] Date of Patent: Sep. 2, 1997

[54] METHOD FOR MANUFACTURING A BAKERY CUTTING DEVICE

[76] Inventor: Wayne B. Barnett, 1252 Woodland Ct., Joliet, Ill. 60436

[21] Appl. No.: 510,381

[22] Filed: Aug. 2, 1995

[51] Int. Cl.[6] ..... B21K 5/20

[52] U.S. Cl. ..... 76/107.8; 30/315

[58] Field of Search ..... 30/315, 316; 76/107.8, 76/107.1

[56] References Cited

U.S. PATENT DOCUMENTS 190,018 4/1877 Erzinger ..... 76/107.8

922,926 5/1909 Lynch ..... 76/107.8

FOREIGN PATENT DOCUMENTS 767438 2/1957 United Kingdom ..... 76/107.8

*Primary Examiner*—Douglas D. Watts

*Attorney, Agent, or Firm*—Cherskov & Flaynik

[57] ABSTRACT

A method for manufacturing a bakery cutting device comprising the steps of selecting a configuration or character, dimensioning the configuration, selecting a deformable metal strip, configuring a plurality of dies to deform pre-selected portions of the metal strip, securing together opposing ends of the metal strip, and attaching handle means to a pre-determined portion of the metal strip.

2 Claims, 19 Drawing Sheets

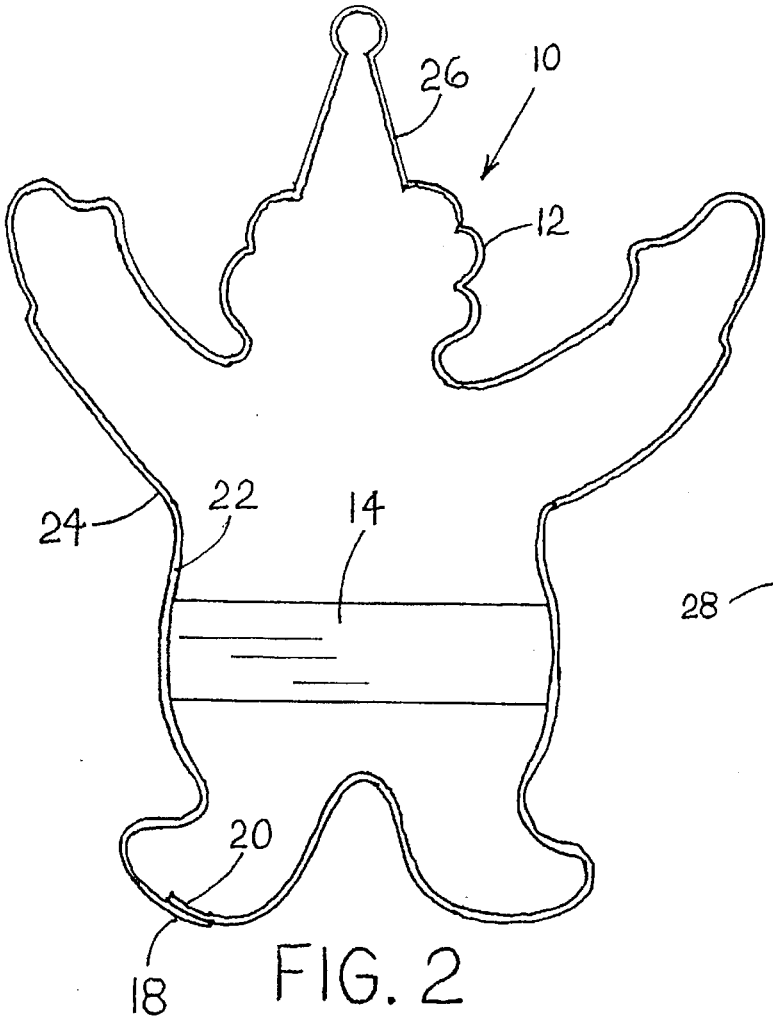
FIG. 2
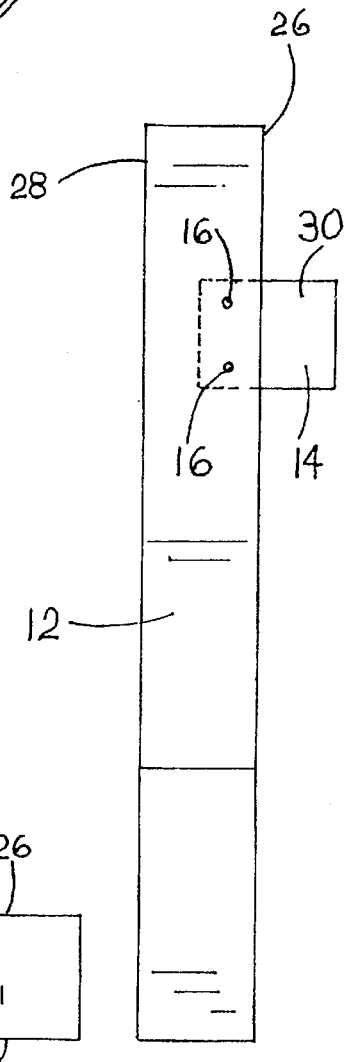
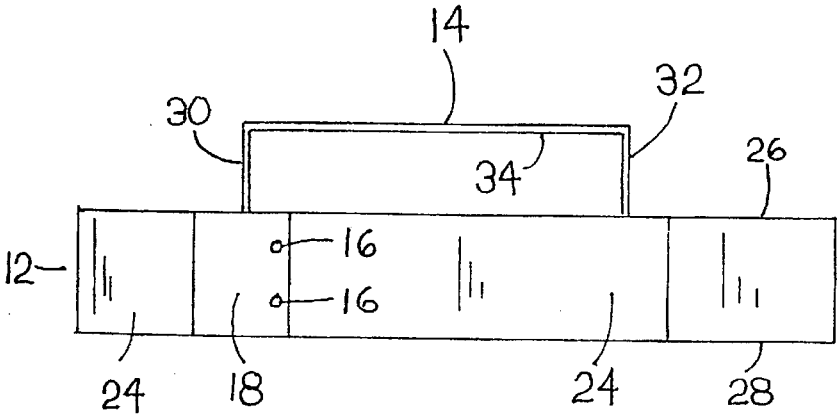
FIG. 3
FIG. 4

METHOD FOR MANUFACTURING A BAKERY CUTTING DEVICE

BACKGROUND OF THE INVENTION

1. Field of the Invention

The present invention relates to cookie and cake cutters and, more particularly, to a method for manufacturing a cutter from a deformable metal strip into any desired configuration.

2. Background of the Prior Art

Cookie cutters have long been utilized to cut shapes from dough to provide cookies of different shapes for eating enjoyment during holidays or special occasions throughout the year. These cutters are usually simple in design and small in size because of the method of construction. The prior art method of constructing cutters is to shape the cutters by hand using rudimentary tools and molds. Prior art methods were the only means to maintain fabrication costs low enough to allow the cutters to be sold at a reasonable retail price. Although maintaining reasonable fabrication costs, prior art methods of manufacturing cookie cutters are not capable of providing low cost elaborate configurations at sizes corresponding to those of a box cake.

SUMMARY OF THE INVENTION

It is an object of the present invention to overcome many of the disadvantages associated with the methods of manufacturing a bakery cutting device. Other objects are to provide a method for manufacturing a bakery cutting device from a deformable metal strip; to provide a method for manufacturing a relatively large bakery cutting device; to provide a method for manufacturing a bakery cutting device having any desired configuration; to provide a method for manufacturing a bakery cutting device economically; and to provide a method for manufacturing a bakery cutting device for cutting cakes and cookies.

The present invention provides a method for manufacturing a bakery cutting device comprising the steps of selecting a configuration; dimensioning said configuration; selecting a deformable metal strip; configuring a plurality of dies to deform pre-selected portions of said metal strip into said selected configuration; securing together opposing ends of said metal strip, thereby deforming said metal strip into said selected configuration; and attaching handle means to said metal strip.

BRIEF DESCRIPTION OF DRAWINGS

These and other objects, advantages and novel features of the present invention, as well as details of an illustrative embodiment thereof, will be more fully understood from the following detailed description and attached drawings, wherein:

FIG. 2 is a top elevation view of a bakery cutter configured as a clown in accordance with this invention.

FIG. 3 is a front elevation view of a bakery cutter configured as a clown in accordance with this invention.

FIG. 4 is a side elevation view of a bakery cutter configured as a clown in accordance with this invention.

DETAILED DESCRIPTION OF THE PREFERRED EMBODIMENT

Figure 1:
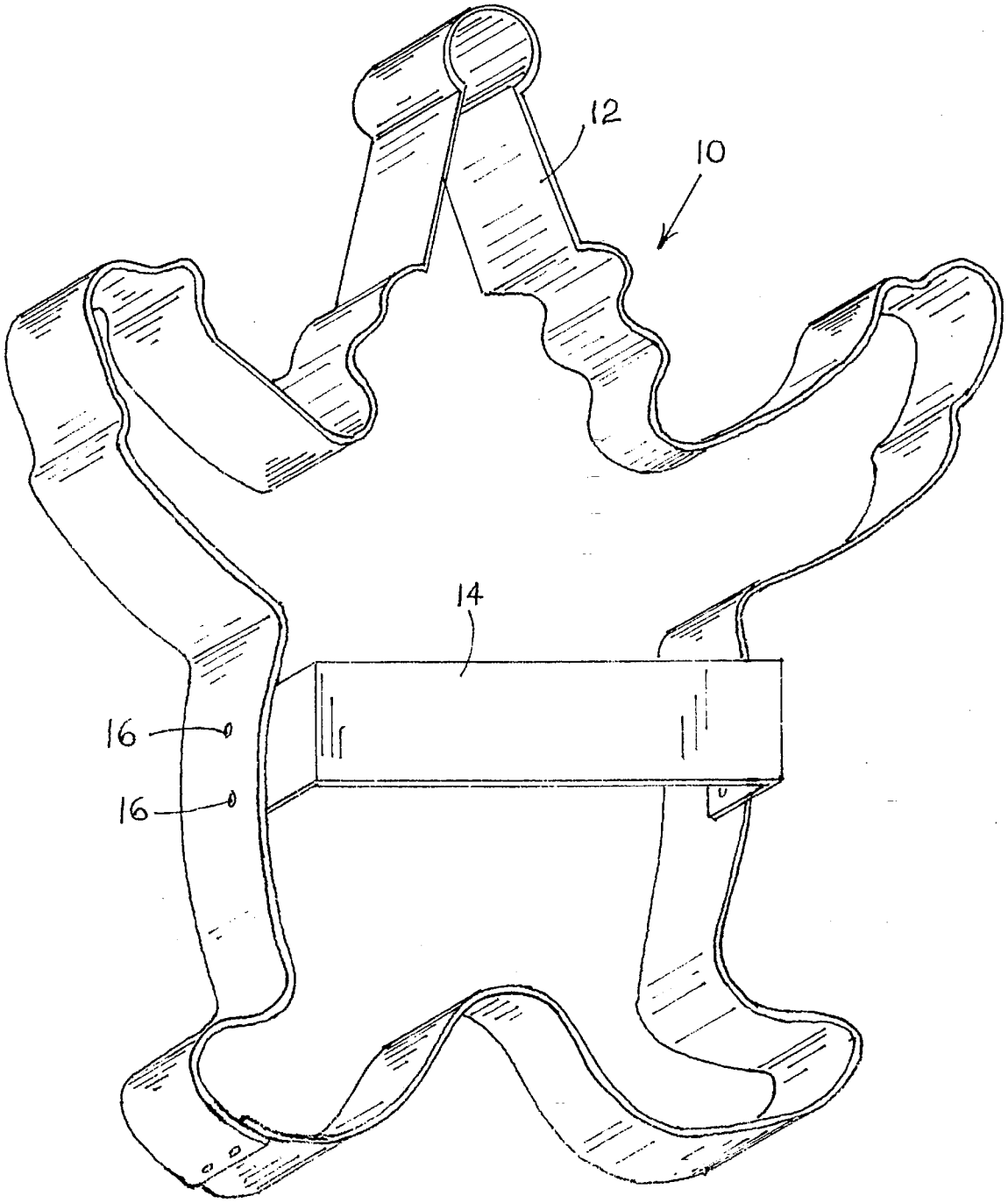
FIG. 1 is a perspective view of a bakery cutter configured as a clown in accordance with this invention.

Referring now to FIGS. 1 through 4, a bakery cutting device configured as a clown in accordance with this invention is denoted by numeral 10. The device or "cutter" 10 includes a metal strip 12, handle 14, and punch lock recess 16.

The metal strip 12 and handle 14 are fabricated from deformable, non-resilient, mill finished aluminum flat sheet having an alloy and temper identification number of 3003H14. The strip 12 and handle 14 total approximately forty-eight (48) inches in length. Both the strip 12 and handle 14 are one and one-half (1½) inches in width and forty-thousandths (0.040) of an inch in thickness.

The metal strip 12 and handle 14 may be fabricated from other materials such as copper and stainless steel. Some commercial bakers use stainless steel, some retail outlets require copper cutters because copper provides a more artistic cutter. The respective thickness of each metal will vary due to the greater rigidity of these metals as compared to aluminum. Also, one may vary the aforementioned aluminum specifications depending on the desired rigidity and the intended use of the cutter. Although intended to cut cakes and cookies, the cutter could be utilized to cut jello, bread, ice cream, chocolate and other food products capable of being cut into a pre-determined configuration. Thus, the harder the food product the more rigid the strip 12 to cut the food product. Utilizing a thicker aluminum strip or a stiffer aluminum alloy, one could then cut a harder food product. However, the trade-off would be a more expensive cutter.

The strip 12 is deformed into a pre-selected configuration utilizing a method to be discussed, infra. After completing the configuration of the strip 12, first and second ends 18 and 20 are joined together to complete the configuration such that portions of first and second planar side walls 22 and 24 are in parallel contact, and first and second edges 26 and 28 form parallel planar rims, thereby allowing the cutter 10 to pass completely through a food product until contacting flush with an underlying support surface.

The handle 14 is joined to the strip 12 by bending first and second end portions 30 and 32 of the handle 14 at right angles to the first side wall 34 of the handle 14, and securing the end portions 30 and 32 to a portion of the first side wall 22 of the strip 12. The positioning of the handle 14 on the strip 12 should allow uniform pressure to be applied to the cutter 10 when pushing on the handle 14, thereby forcing the strip 12 through a baked box cake or other food product. Further, the distance between the first side wall 34 of the handle 14 and the second edge 28 of the strip 12 should be approximately two and one-half (2½) inches. This dimension provides enough space between one's fingers when grasping the handle 14 and the top of a cake or other food product to be cut while maintaining enough rigidity in the handle 14 to prevent the handle 14 from collapsing under the pressure impressed upon the handle 14 when pressing the cutter 10 through the food product.

The joining of the strip end portions 18 and 20, and the handle 14 to the strip 12 is accomplished by using a mechanical punch lock machine similar to BTM Corporation Fastening Press, Serial No. 014-85. The punch lock strikes the selected surfaces held adjacent to each other and creates recess 16, thereby forming a force fit between selected surfaces strong enough to hold the surfaces together when pressing the cutter 10 through a food product. Other securing means could be utilized such as rivets or screws, but these items would increase labor costs to assemble the cutter 10 as well as providing a sharp edge for one to cut themself upon.

Referring to FIGS. 1 through 8, perspective and elevation views of cutter 10, configured in the shape of a clown and snowman, are depicted. The method or process to manufacture the cutter 10 is to first draw a detailed picture of the configuration or character chosen. The picture is then scanned and downloaded into a computer and displayed on a computer screen. A rectangular box having dimensions of thirteen (13) inches in length and nine (9) inches in width is superimposed upon the screen containing the selected configuration therein. A scanning software similar to that provided by Logitech Corporation is utilized to stretch or shrink the configuration, in this use, a clown or snowman, until it is entirely within the perimeter of the box. The rectangular box represents the most popular size of cake pan (13"×9") which would be utilized to bake the cake that the cutter 10 would configure. The computer then prints a full scaled picture which will then be used to construct a series of dies that deform the strip 12 into the desired configuration.

The dies utilized to configure the aluminum strip 12 are fabricated from a hard wood such as red oak, or a plastic block. Steel or other metals could be used, but the cost to shape metal dies would be prohibitively expensive, whereas using wood or plastic allows the cutter 10 to be economically manufactured. The wooden or plastic dies are approximately seven (7) inches square when viewed from the top and two (2) inches thick when viewed from the front or side. The dies are cut to conform to pre-selected portions of the picture printed by a computer as detailed above. The pre-selected portions are chosen by allowing only one (1) severe angle of bend to occur when pressing the aluminum strip 12 between any two dies which will be more apparent when reviewing the configuration of a clown cutter 10, infra.

Figure 9:
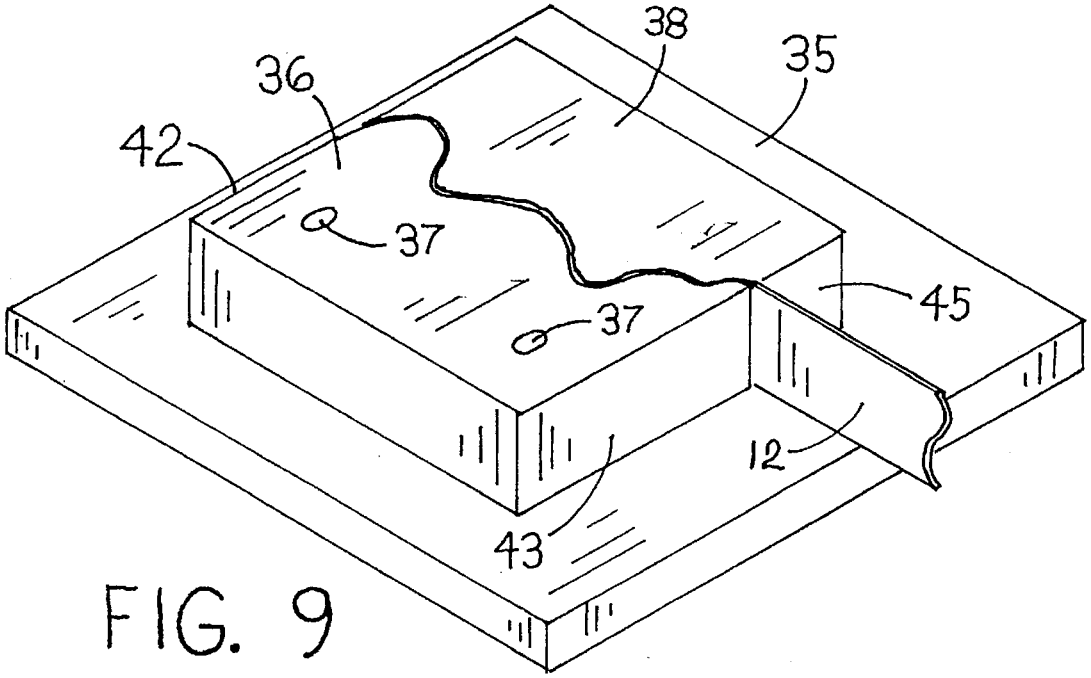
FIG. 9 is a perspective view of cutter forming dies that form Section 1 of FIG. 2A together with a metal strip extending therefrom.

Two dies are required to deform each pre-selected portion of strip 12. The present invention secures one die to a metal plate 35 (see FIG. 9) approximately nine (9) inches square and one-half (½) inch thick, via mounting bolts 37 which extend through die 36 and into threaded orifices in the plate 35. The plate 35 is then secured to a hydraulic work station where a hydraulic cylinder and shaft are utilized to force non-stationary die 38 against stationary die 36 with aluminum strip 12 therebetween. The strip 12 is positioned such that the second edge 28 is in parallel contact with the planar surface of the plate 35 and first and second side walls 22 and 24 are perpendicular to the planar surface of the plate 35. The hydraulic pressure required to force the dies 36 and 38 together with the strip 12 therebetween is approximately four thousand (4,000) pounds. The equipment required to generate this amount of force is well known to a person of ordinary skill in dealing with hydraulics. After being pressed between the dies, the aluminum strip 12 is permanently deformed to the contoured configuration of the pressing walls of the dies.

Figure 2A:
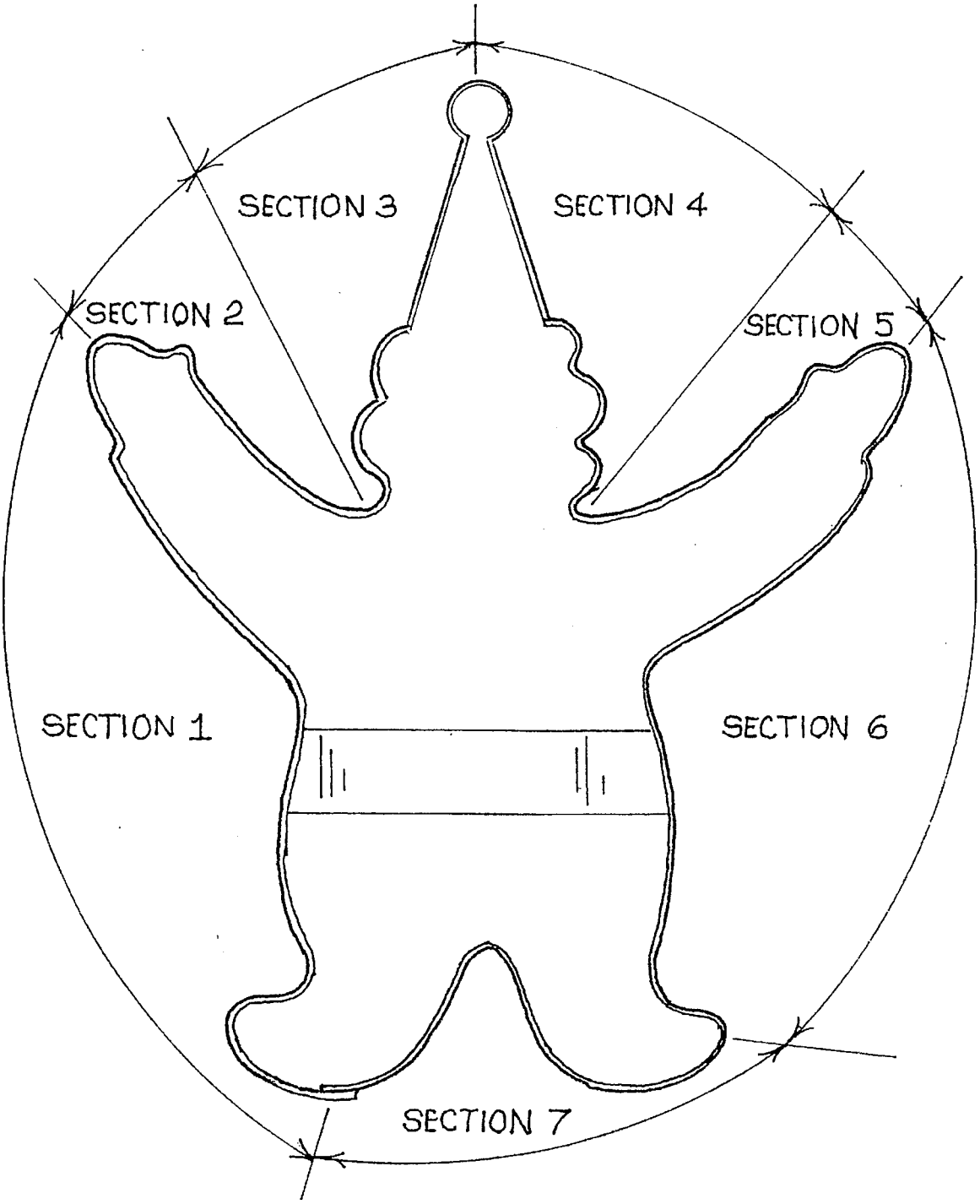
FIG. 2A is a top elevation view showing the bend sections corresponding to the die drawings, infra.
Figure 5:
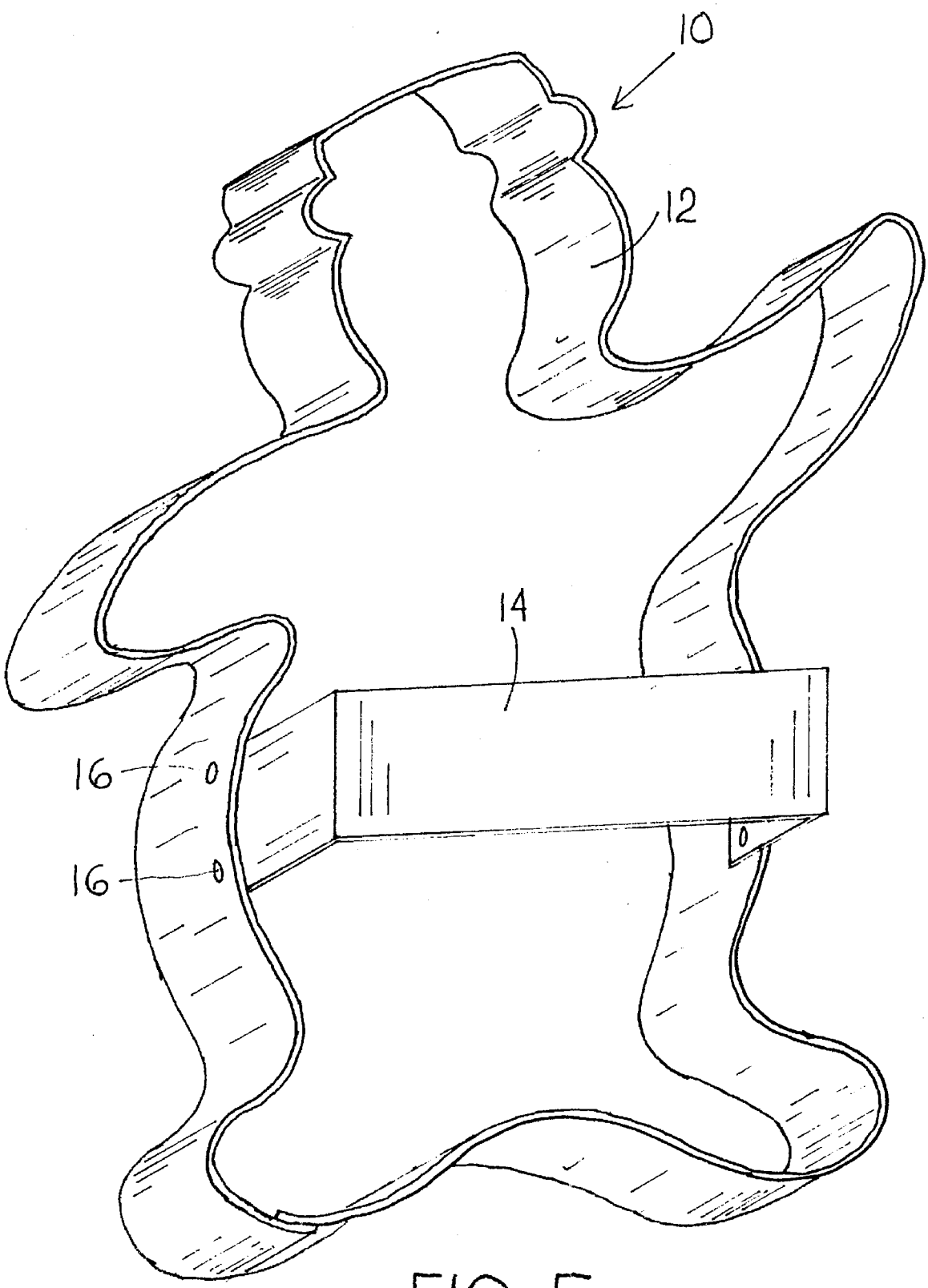
FIG. 5 is a perspective view of a bakery cutter configured as a snowman in accordance with this invention.
Figure 6:
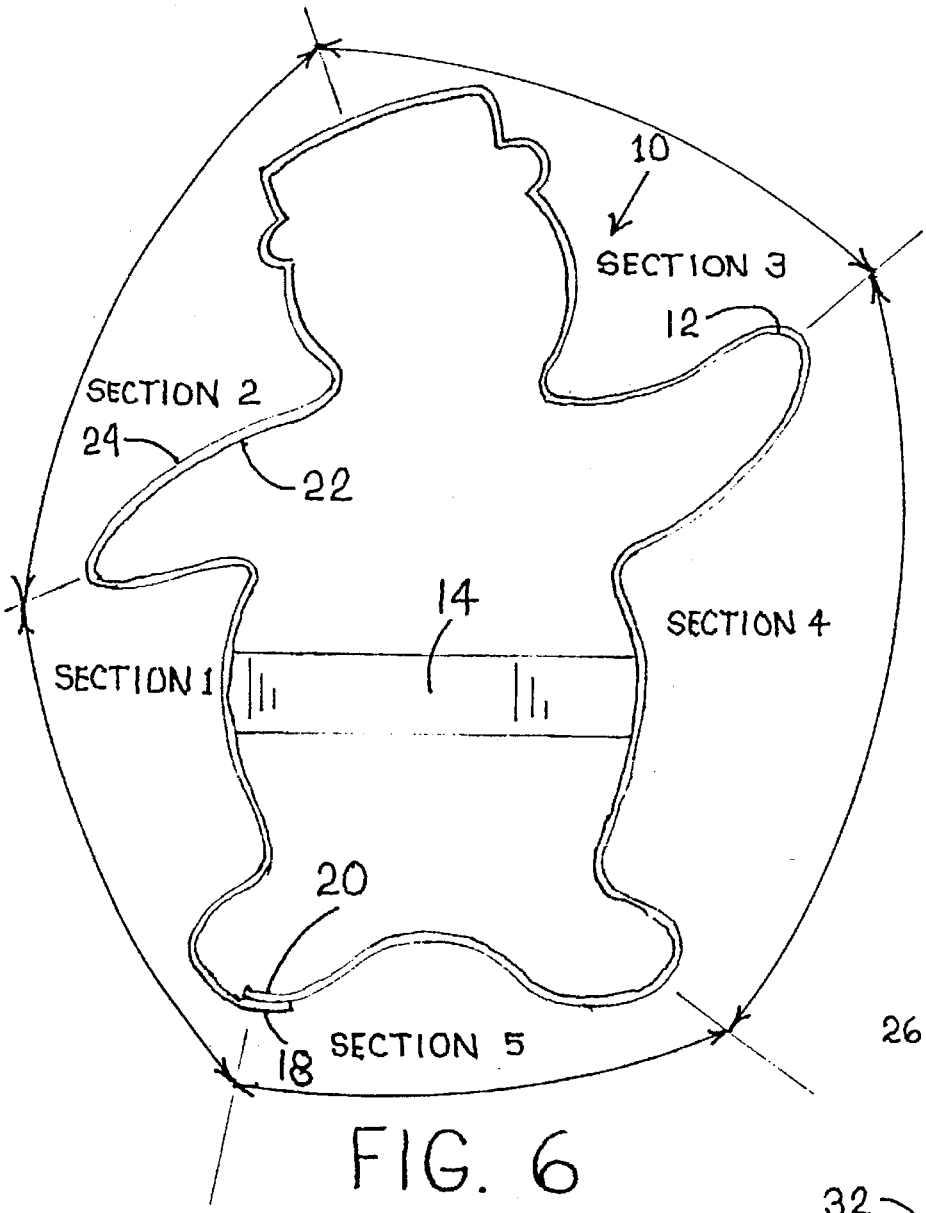
FIG. 6 is a top elevation view showing the bend sections corresponding to cutter forming dies.
Figure 7:
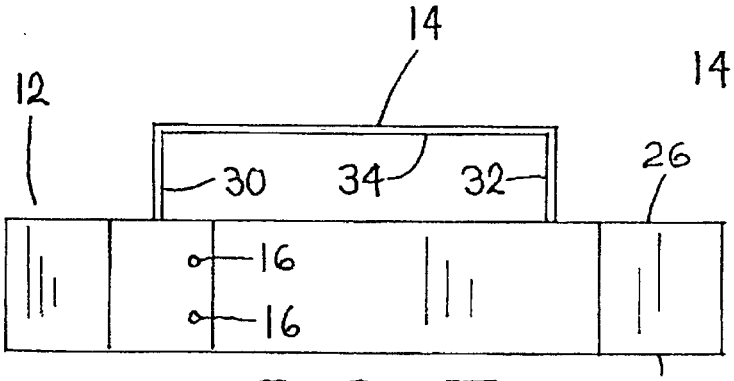
FIG. 7 is a front elevation view of a bakery cutter configured as a snowman in accordance with this invention.
Figure 8:
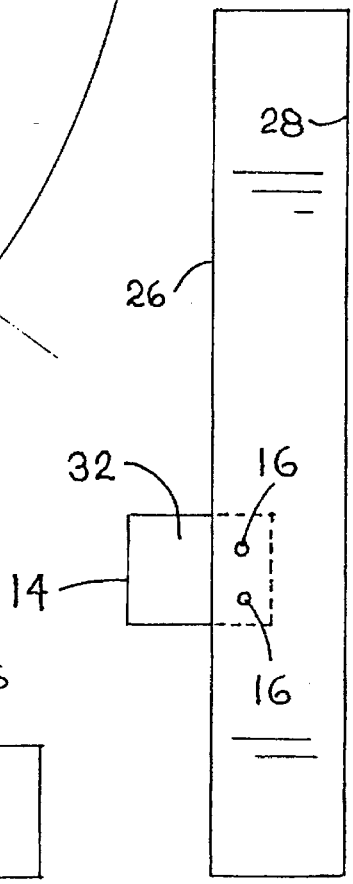
FIG. 8 is a side elevation view of a bakery cutter configured as a snowman in accordance with this invention.

Referring to FIG. 2A, a top elevation view of a clown cutter 10 having seven (7) sections corresponding to seven (7) sets of dies that shape the clown cutter 10 is depicted.

Figure 9A:
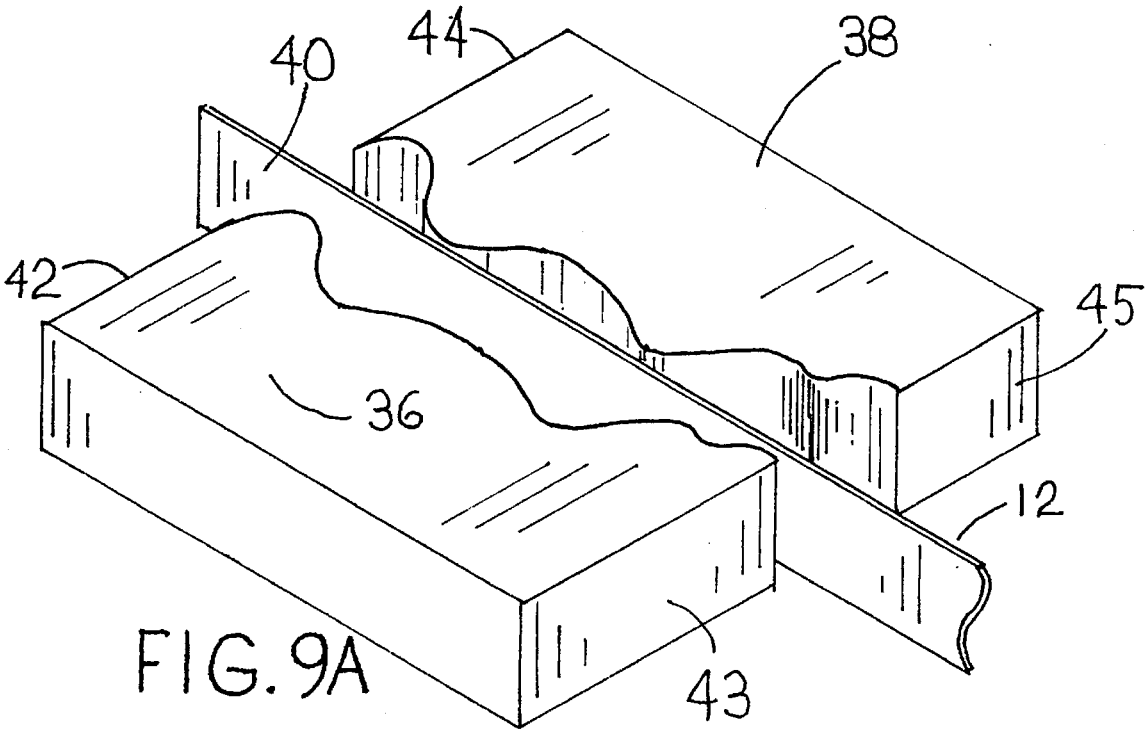
FIG. 9A is a perspective view of cutter forming dies that form Section 1 of FIG. 2A apart, with a non-deformed metal strip inserted therebetween.
Figure 10:
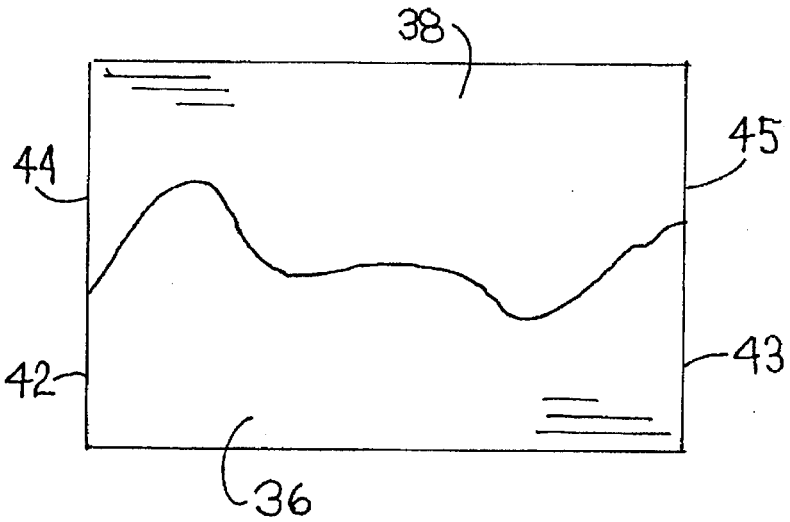
FIG. 10 is a top elevation view of cutter forming dies that form Section 1 of FIG. 2A.
Figure 11:
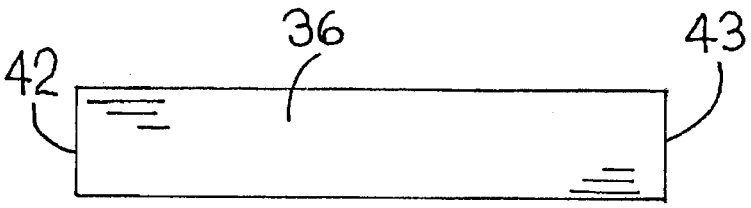
FIG. 11 is a front elevation view of cutter forming dies that form Section 1 of FIG. 2A.
Figure 12:
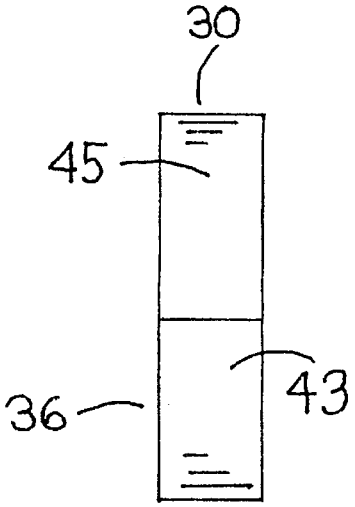
FIG. 12 is a side elevation view of cutter forming dies that form Section 1 of FIG. 2A.

The number one (1) Section of the clown cutter 10 is formed by the dies 36 and 38 depicted in FIGS. 9 through 12. Referring to FIG. 9A, dies 36 and 38 are separated with strip 12 inserted therebetween. One should note that an extension portion 40 of strip 12 extends beyond first side walls 42 and 44 of dies 36 and 38. This extension is required because the aluminum strip 12 is drawn inward between the dies 36 and 38 from each portion of strip 12 extending beyond first side walls 42 and 44, and opposite second side walls 43 and 45 of dies 36 and 38.

After the dies 36 and 38 are completely pressed together (see FIGS. 9 & 9A), the extension portion 40 of aluminum strip 12 will be flush with the first side walls 42 and 44. The exact length of the extension portion 40 must be estimated initially, then adjusted in length with a new unbent strip 12 by trial and error until becoming flush with the first side walls 42 and 44 after pressing the dies 36 and 38 together. When the dies 36 and 38 are drawn apart, the strip 12 will remain deformed as depicted in the first section of FIG. 2A.

Figure 13:
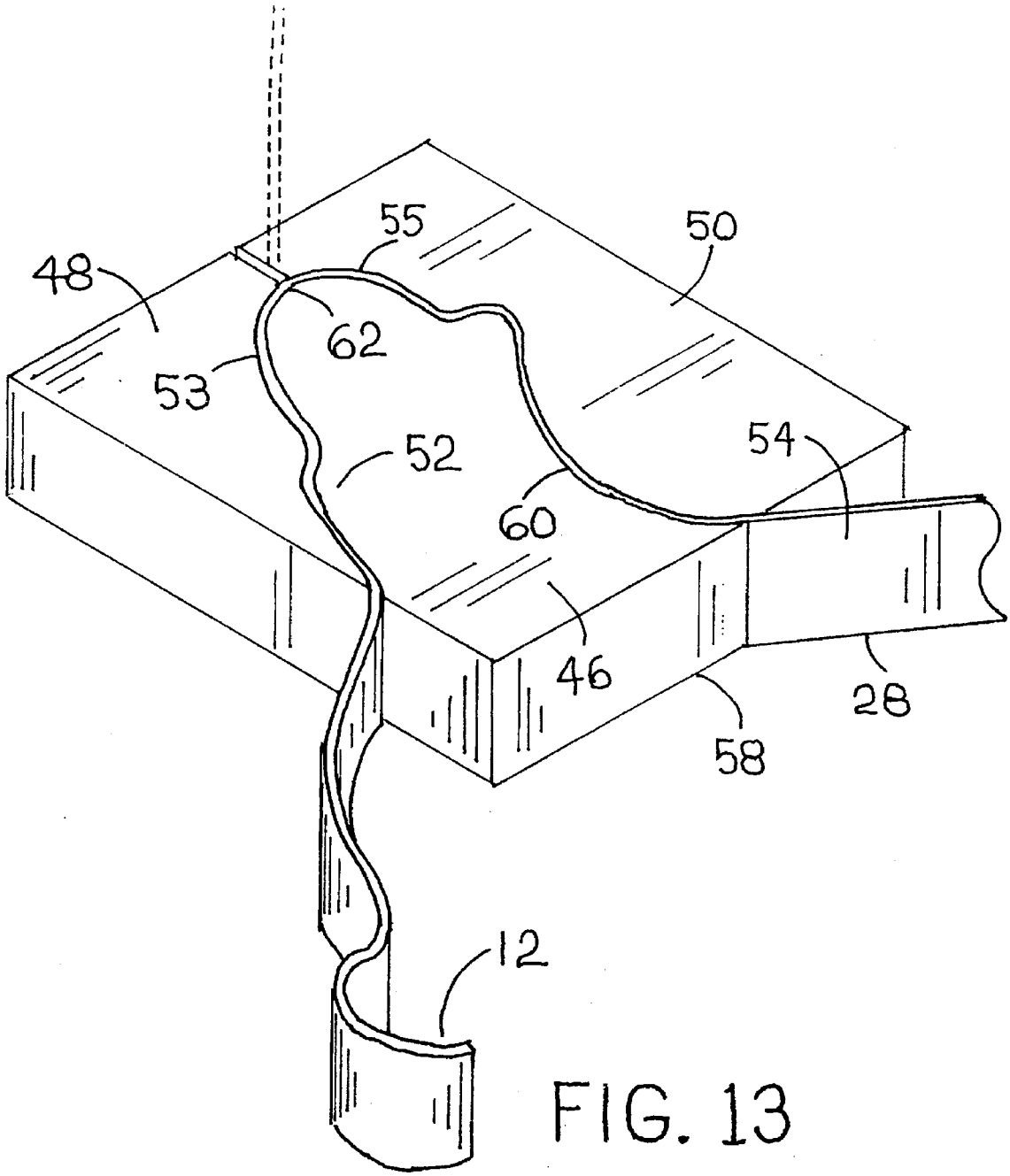
FIG. 13 is a perspective view of cutter forming dies that form Section 2 of FIG. 2A, together with a deformed metal strip extending therefrom.
Figure 14:
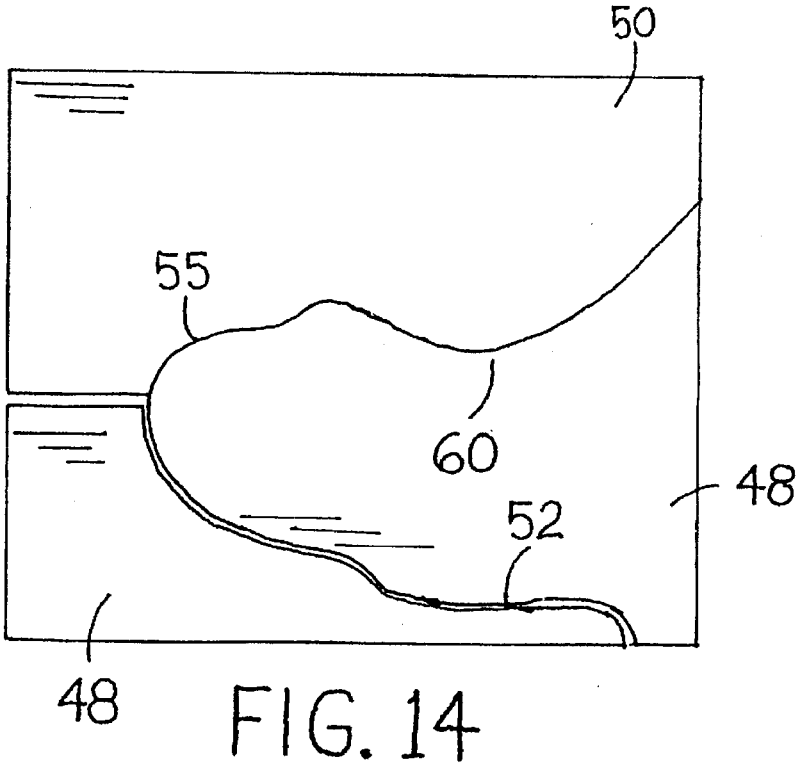
FIG. 14 is a top elevation view of cutter forming dies that form Section 2 of FIG. 2A.
Figure 15:
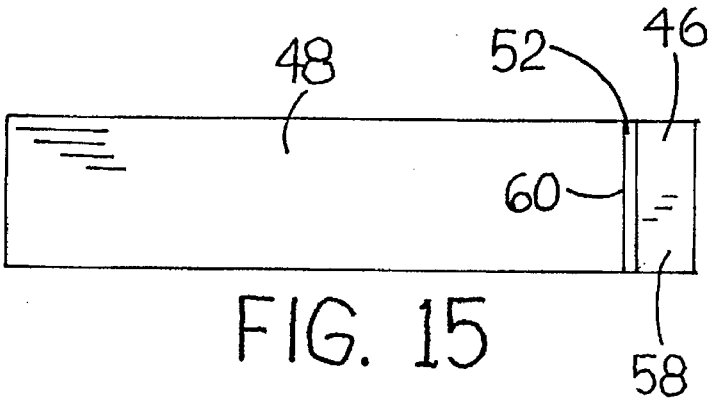
FIG. 15 is a front elevation view of cutter forming dies that form Section 2 of FIG. 2A.
Figure 16:
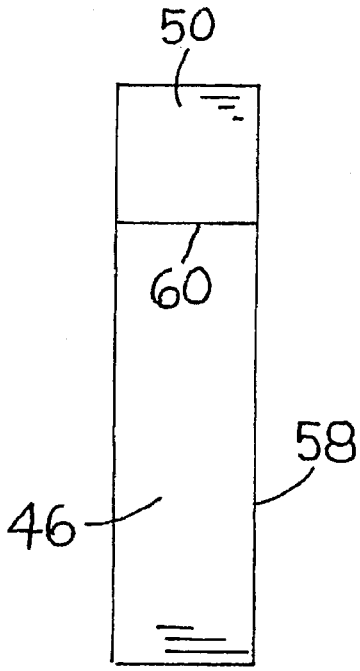
FIG. 16 is a side elevation view of cutter forming dies that form Section 2 of FIG. 2A.

Referring to FIGS. 13 through 16, perspective and elevation views of the dies 46, 48 and 50 utilized to form Section 2 (see FIG. 2A) of the clown cutter 10 are depicted with strip 12 included in FIG. 13. One should note that there are three (3) dies that form Section 2 as compared to the two (2) dies 36 and 38 required to form Section 1. Dies 46 and 48 establish a positioning slot 52 used to prevent previously deformed Section 1 from being drawn between dies 46 and 50 when the dies are pressed together to form Section 2 of clown cutter 10.

The positioning slot 52 receives a restraining portion 53 of Section 1 of strip 12. A straight portion 54 of strip 12 protrudes longitudinally beyond side wall 55 of die 46. One must physically bend the straight portion 54 in the direction of arrow 56 while keeping the second edge 28 of strip 12 in the same plane with lower planar surface 58 of die 46 until the strip 12 contacts the pressing wall 60 of die 46. Die 50 is then pressed against die 46, thereby forming Section 2 of clown cutter 10.

The sizes of the positioning slot 52 and the corresponding restraining portion 53 required to prevent the deformed Section 1 portion from being drawn between dies 46 and 50 is dependent upon the angle formed when bending the straight portion 54 against the pressing wall 60 of die 46. The greater the angle of bend, the greater the friction between the strip 12 and the die 46 at a starting point 62 on die 46 that begins the formation of Section 2 of the strip 12. The greater the friction between the strip 12 and starting point 62, the smaller the positioning slot 52 required to prevent deformed Section 1 from being drawn between dies 46 and 50. Through trial and error, it has been determined that positioning slot 52 needs to be approximately two and one-half (2½) inches in length to restrain Section 1 of strip 12.

Figure 17:
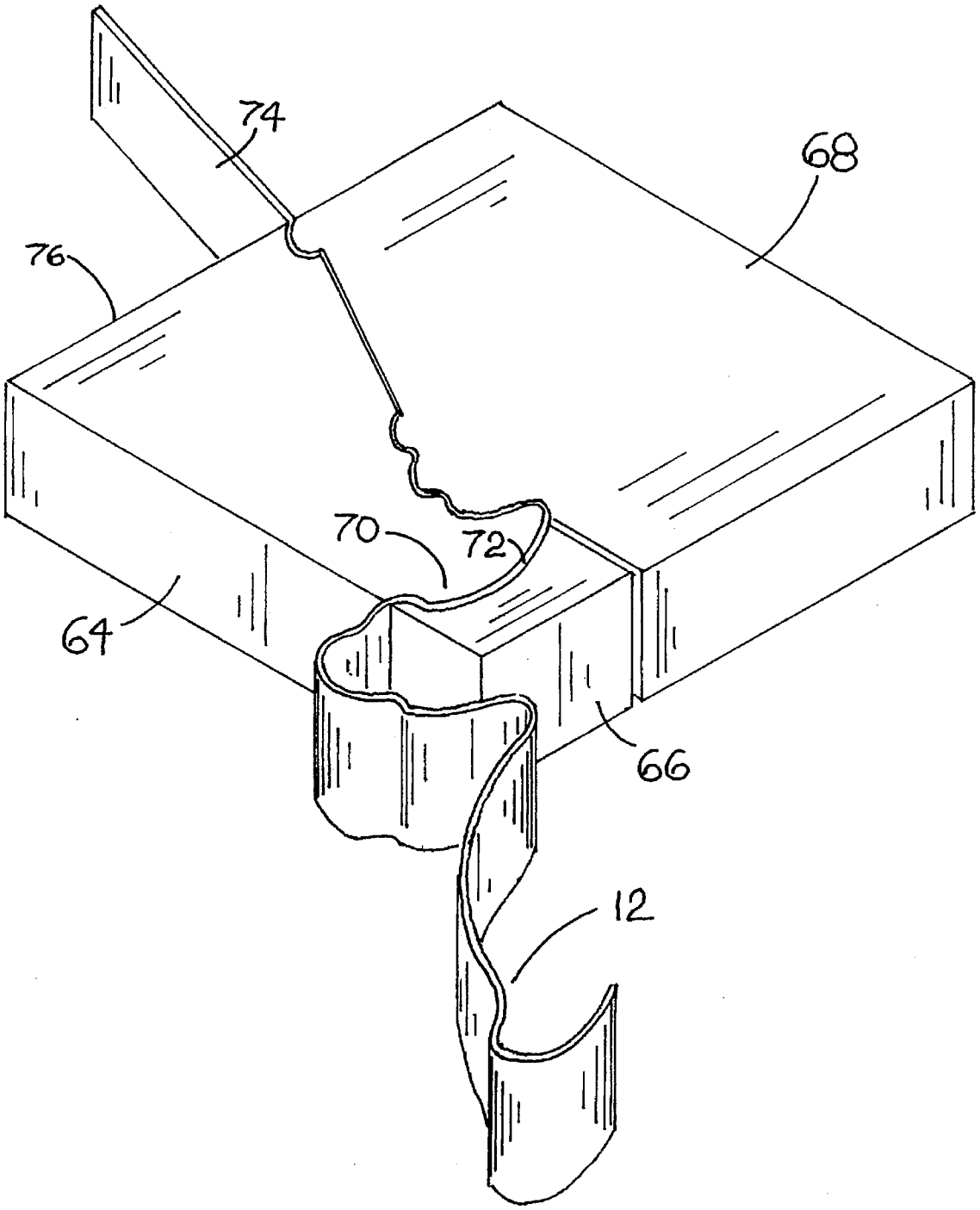
FIG. 17 is a perspective view of cutter forming dies that form Section 3 of FIG. 2A, together with a deformed metal strip extending therefrom.
Figure 18:
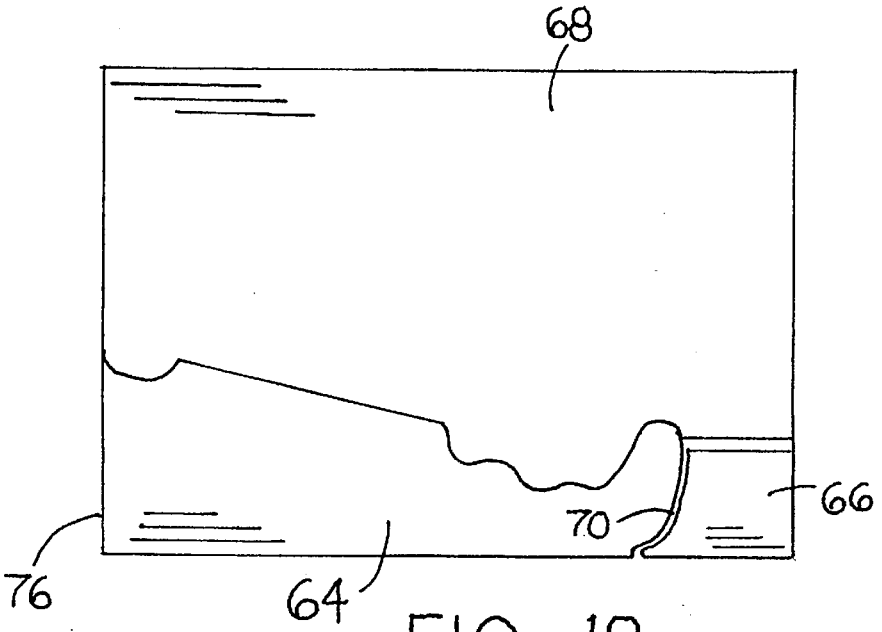
FIG. 18 is a top elevation view of cutter forming dies that form Section 3 of FIG. 2A.
Figure 19:
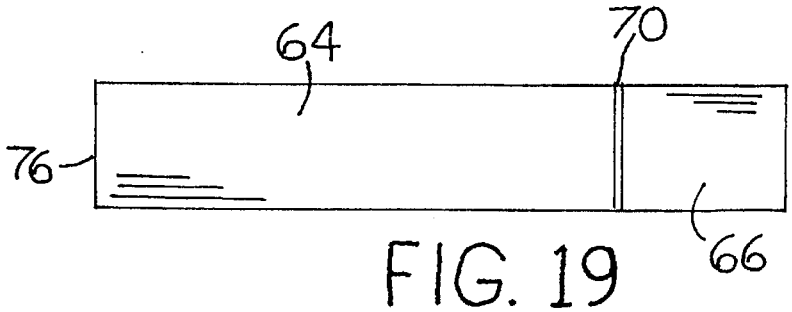
FIG. 19 is a front elevation view of cutter forming dies that form Section 3 of FIG. 2A.
Figure 20:
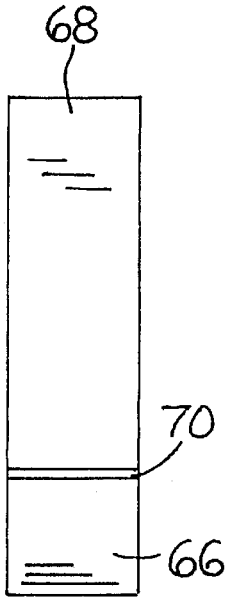
FIG. 20 is a side elevation view of cutter forming dies that form Section 3 of FIG. 2A.
Figure 21:
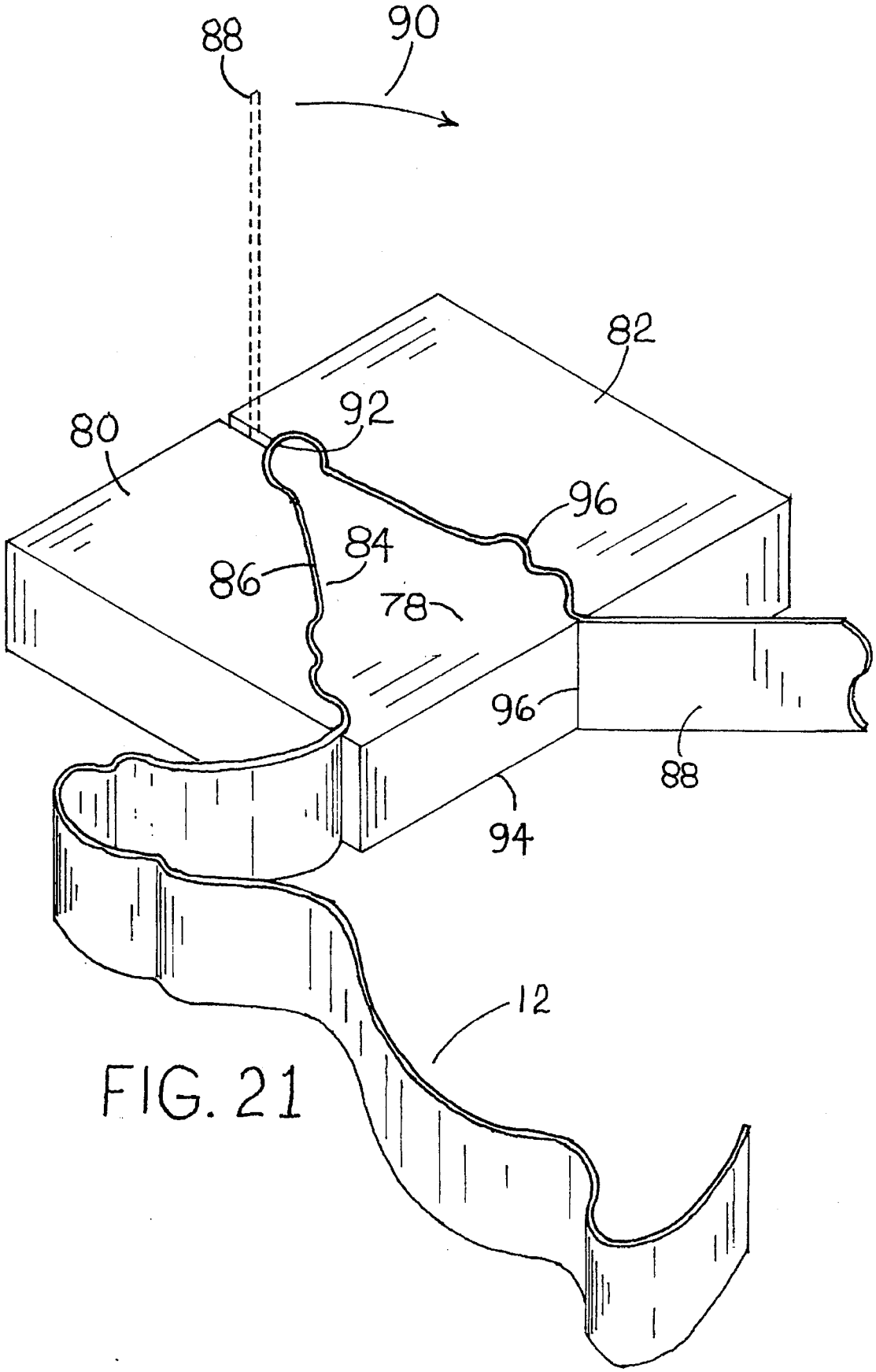
FIG. 21 is a perspective view of cutter forming dies that form Section 4 of FIG. 2A, together with a deformed metal strip extending therefrom.
Figure 22:
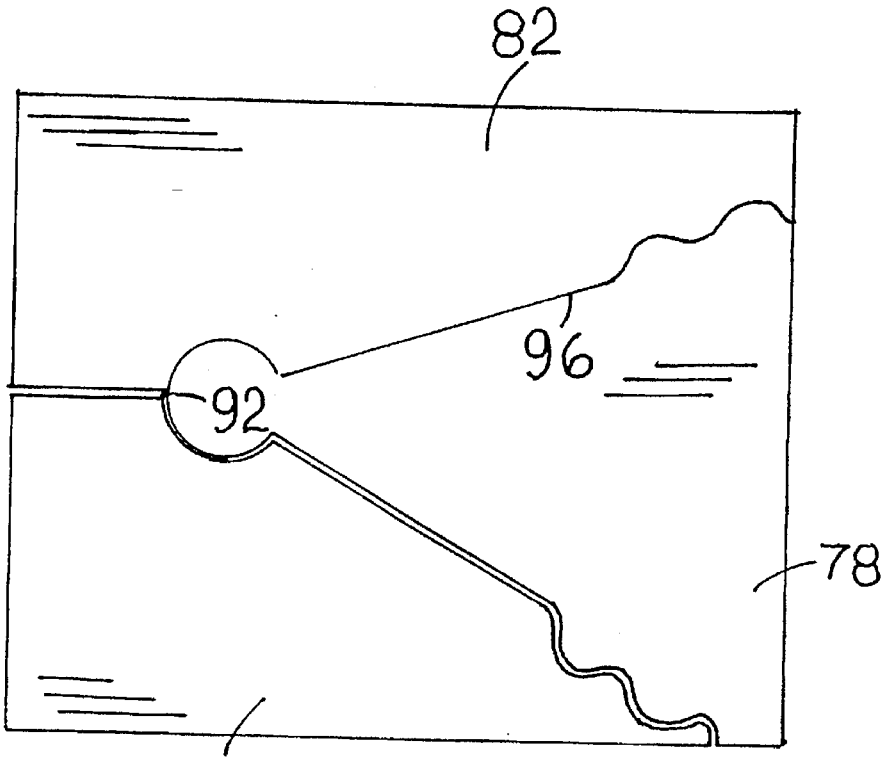
FIG. 22 is a top elevation view of cutter forming dies that form Section 4 of FIG. 2A.
Figure 23:
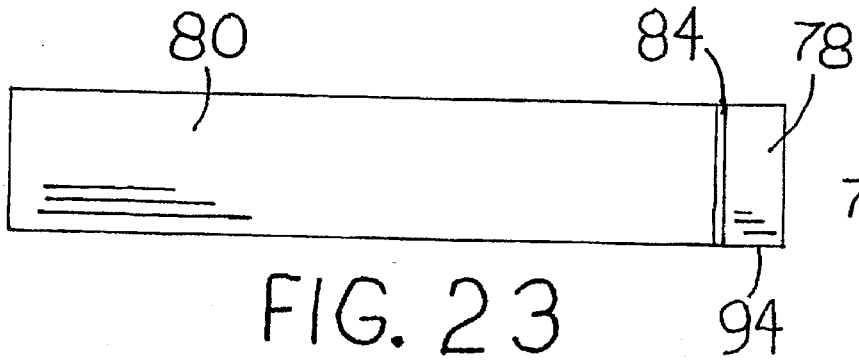
FIG. 23 is a front elevation view of cutter forming dies that form Section 4 of FIG. 2A.
Figure 24:
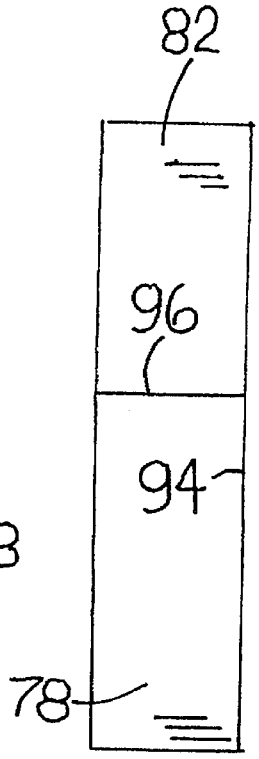
FIG. 24 is a side elevation view of cutter forming dies that form Section 4 of FIG. 2A.
Figure 25:
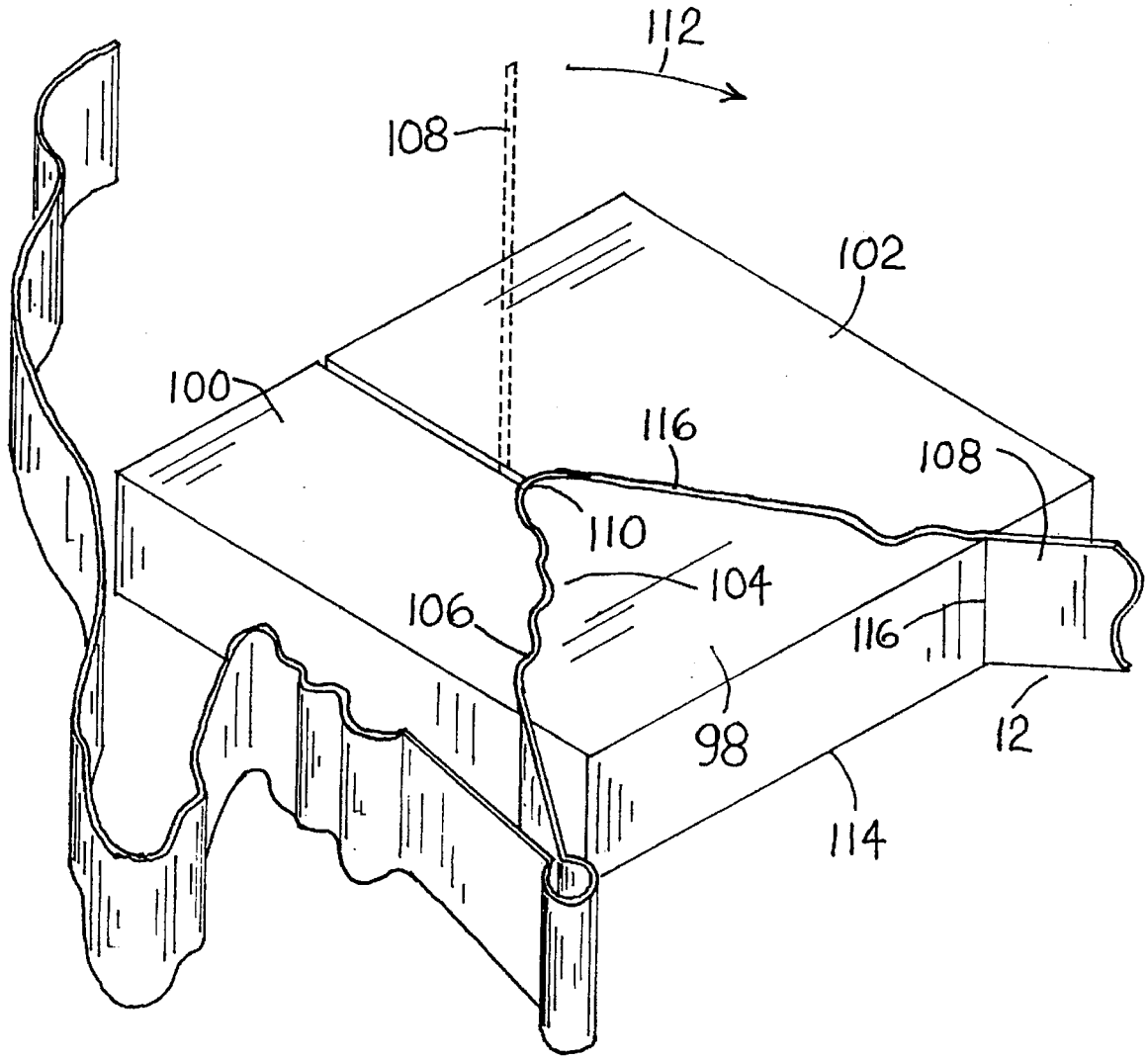
FIG. 25 is a perspective view of cutter forming dies that form Section 5 of FIG. 2A, together with a deformed metal strip extending therefrom.
Figure 26:
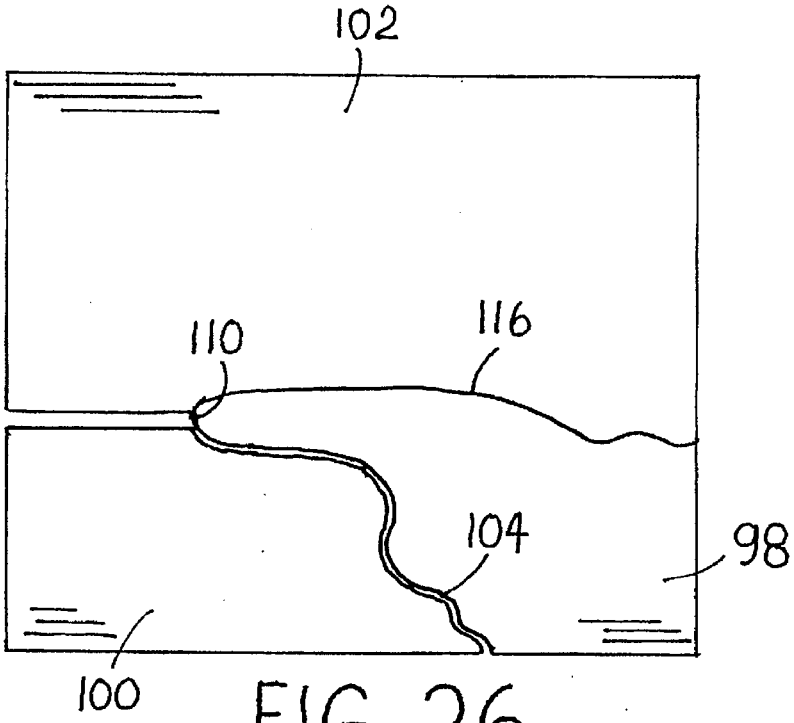
FIG. 26 is a top elevation view of cutter forming dies that form Section 5 of FIG. 2A.
Figure 27:
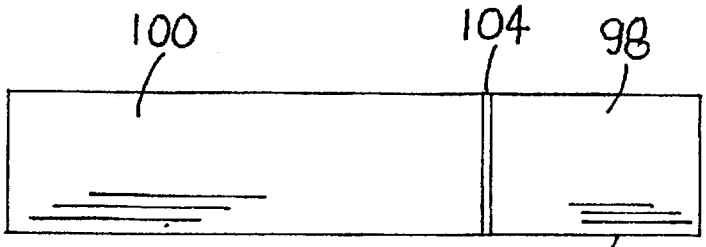
FIG. 27 is a front elevation view of cutter forming dies that form Section 5 of FIG. 2A.
Figure 28:
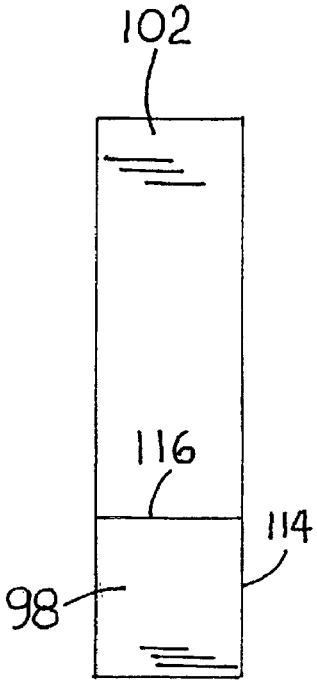
FIG. 28 is a side elevation view of cutter forming dies that form Section 5 of FIG. 2A.
Figure 29:
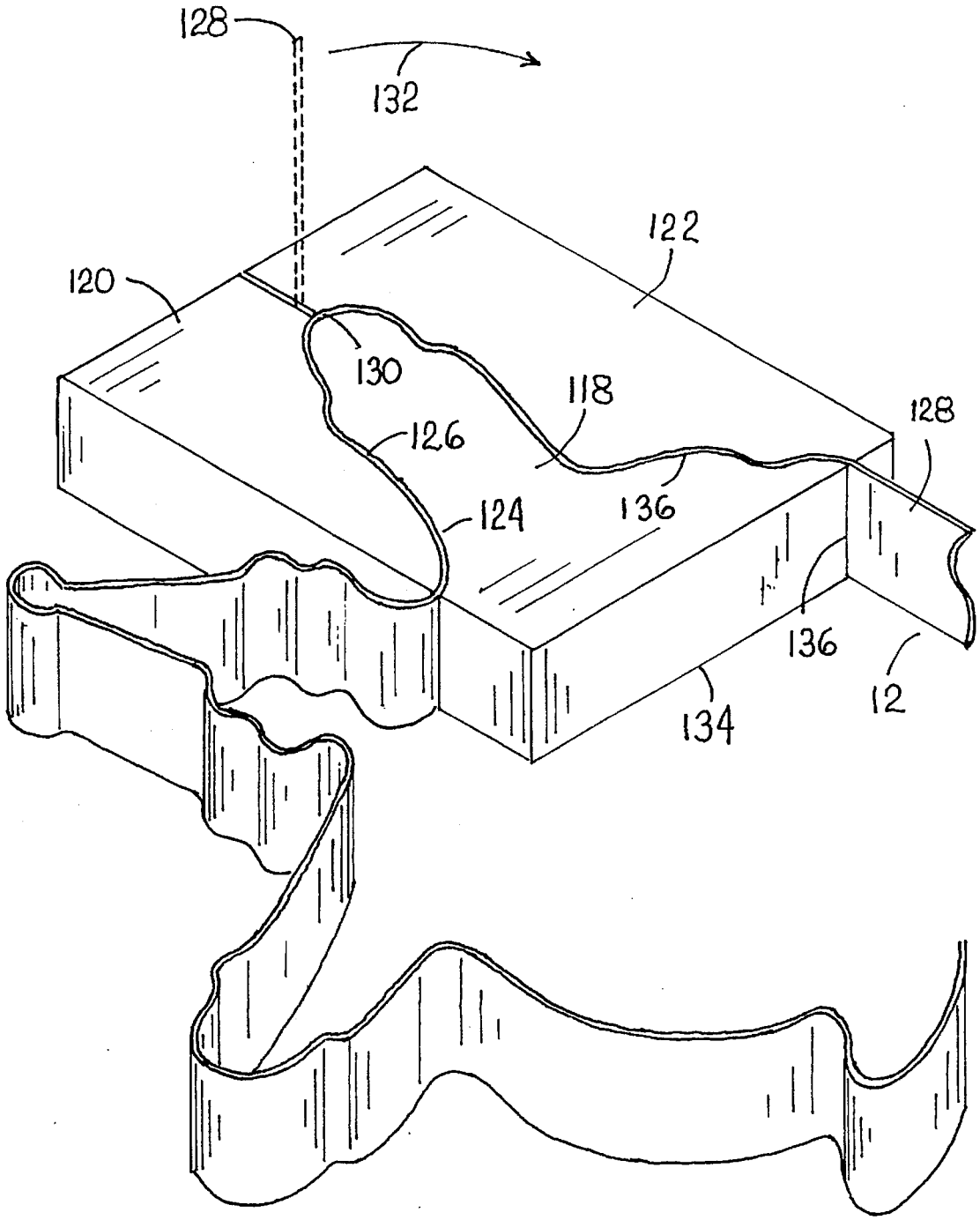
FIG. 29 is a perspective view of cutter forming dies that form Section 6 of FIG. 2A, together with a deformed metal strip extending therefrom.
Figure 30:
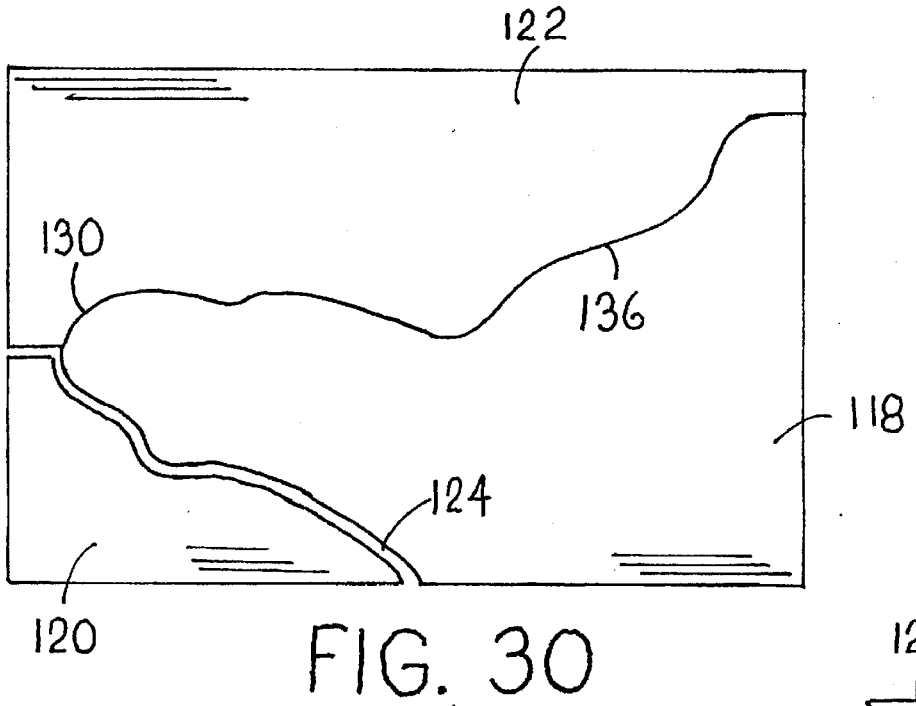
FIG. 30 is a top elevation view of cutter forming dies that form Section 6 of FIG. 2A.
Figure 31:
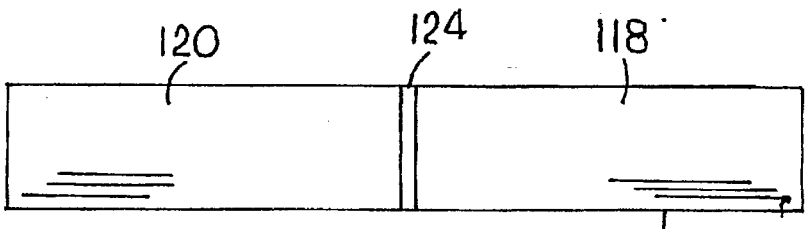
FIG. 31 is a front elevation view of cutter forming dies that form Section 6 of Section 2A.
Figure 32:
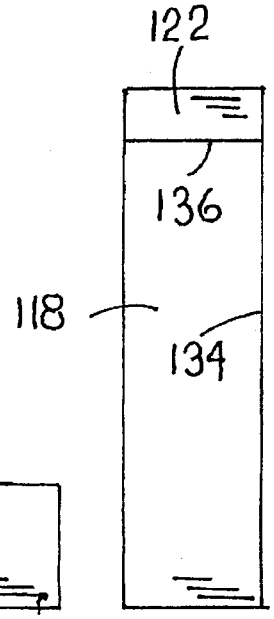
FIG. 32 is a side elevation view of cutter forming dies that form Section 6 of FIG. 2A.
Figure 33:
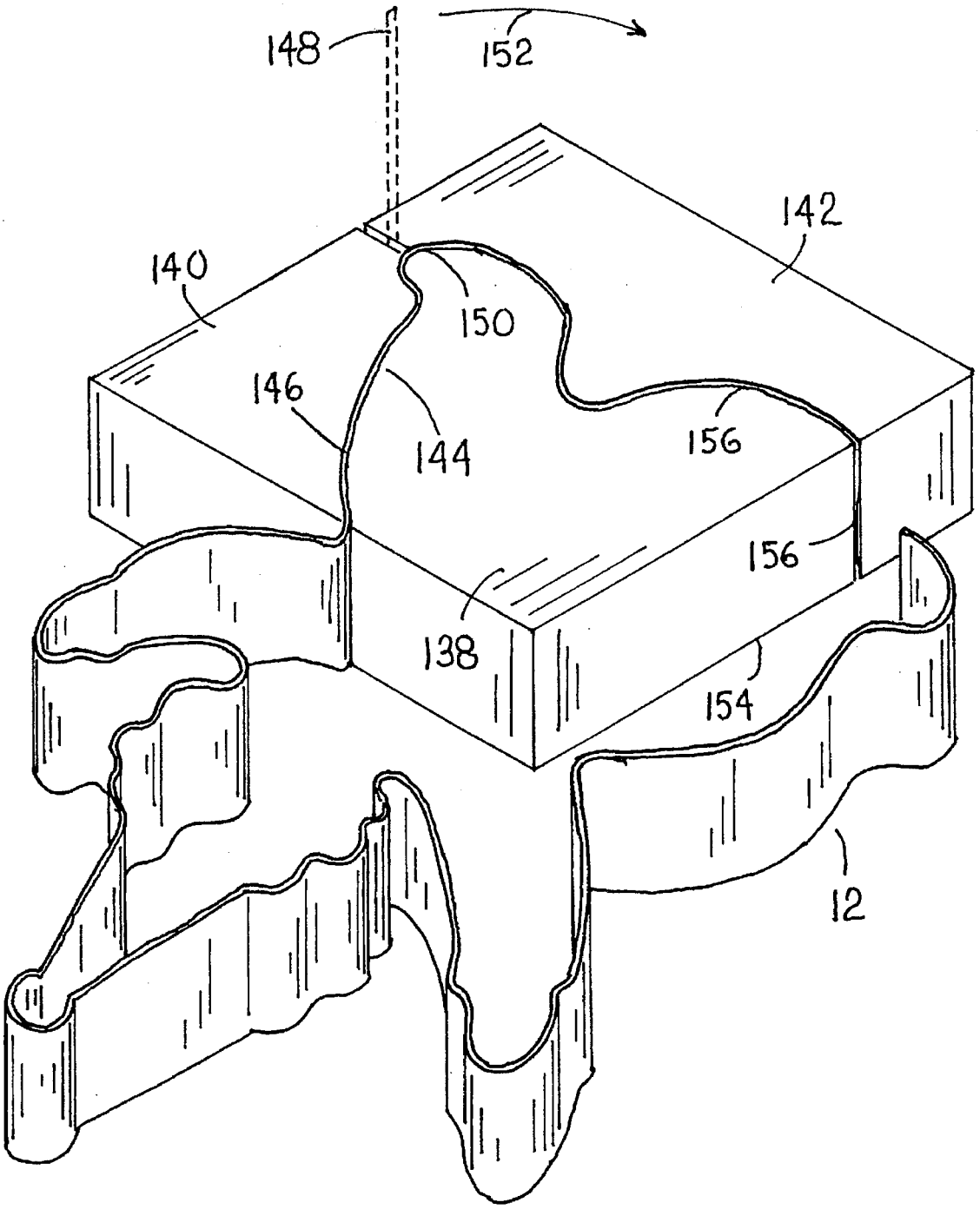
FIG. 33 is a perspective view of cutter forming dies that form Section 7 of FIG. 2A, together with a deformed metal strip in a clown configuration extending therefrom.
Figure 34:
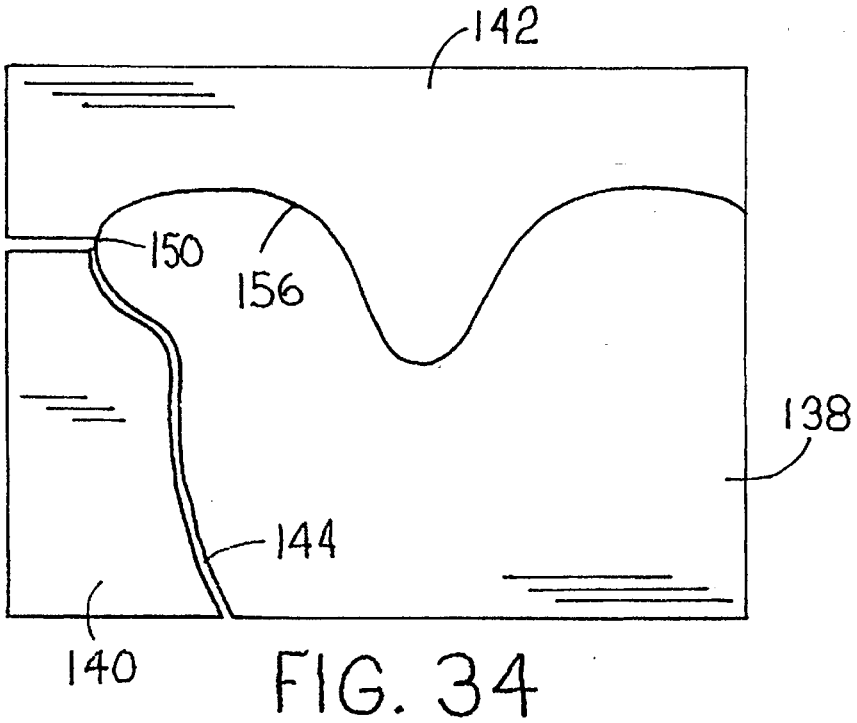
FIG. 34 is a top elevation view of cutter forming dies that form Section 7 of FIG. 2A.
Figure 35:
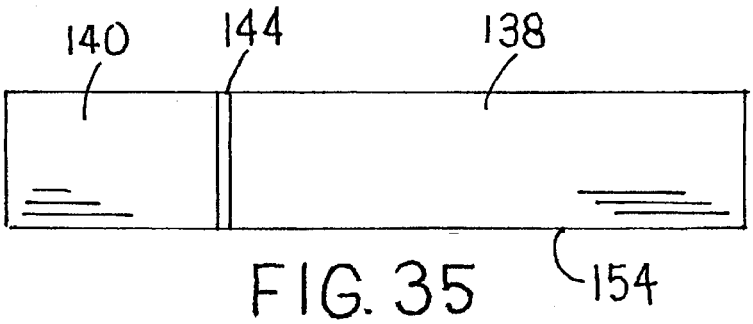
FIG. 35 is a front elevation view of cutter forming dies that form Section 7 of FIG. 2A.
Figure 36:
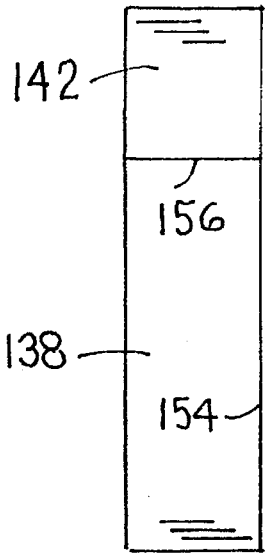
FIG. 36 is a side elevation view of cutter forming dies that form Section 7 of FIG. 2A.

Referring to FIGS. 17 through 20, perspective and elevation views of dies 64, 66 and 68 utilized to form Section 3 (see FIG. 2A) of the clown cutter 10 are depicted with strip 12 included in FIG. 17. Again, there are three (3) dies required to form Section 3. Dies 64 and 66 establish positioning slot 70 required to prevent previously deformed Section 2 from being drawn between dies 64 and 68 when pressed together to form Section 3 of clown cutter 10.

The positioning slot 70 receives restraining portion 72 of Section 2 of strip 12. A straight portion 74 of strip 12 protrudes longitudinally beyond side wall 76 of die 64. Straight portion 74 does not need to be physically bent in this Section. Die 68 is then pressed against die 64, thereby forming Section 3 of clown cutter 10. The size of the positioning slot required to restrain Section 2 of strip 12 is approximately three (3) inches.

Referring to FIGS. 21 through 24, perspective and elevation views of dies 78, 80 and 82 utilized to form Section 4 (see FIG. 2A) of the clown cutter 10 are depicted with strip 12 included in the perspective view. Dies 78 and 80 establish positioning slot 84 required to prevent previously deformed Section 3 from being drawn between dies 78 and 82 when pressed together to form Section 4 of clown cutter 10.

The positioning slot 84 receives restraining portion 86 of Section 3 of strip 12. A straight portion 88 of strip 12 protrudes longitudinally beyond side wall 92 of die 78. Straight portion 90 must be physically bent in the direction of arrow 56 while keeping the second edge 28 of strip 12 in the same plane with lower planar surface 94 of die 78 until the strip 12 contacts the pressing wall 96 of die 78. Die 82 is then pressed against die 78, thereby forming Section 4 of clown cutter 10. The size of the positioning slot 84 required to restrain Section 3 of strip 12 is approximately four and one-half (4½) inches.

Referring to FIGS. 25 through 28, perspective and elevation views of dies 98, 100 and 102 utilized to form Section 5 (see FIG. 2A) of the clown cutter 10 are depicted with strip 12 included in the perspective view. Dies 98 and 100 establish positioning slot 104 required to prevent previously deformed Section 4 from being drawn between dies 98 and 102 when pressed together to form Section 5 of the clown cutter 10.

The positioning slot 104 receives restraining portion 106 of Section 4 of strip 12. A straight portion 108 of strip 12 protrudes longitudinally beyond side wall 110 of die 98. Straight portion 108 must be bent in the direction of arrow 112 while keeping second edge 28 of strip 12 in the same plane with lower planar surface 114 of die 98 until the strip 12 contacts the pressing wall 116 of die 98. Die 102 is then pressed against die 98, thereby forming Section 5 of clown cutter 10. The size of positioning slot 104 required to restrain Section 4 of strip 12 is approximately three (3) inches.

Referring to FIGS. 29 through 32, perspective and elevation views of dies 118, 120 and 122 utilized to form Section 6 (see FIG. 2A) of the clown cutter 10 are depicted with strip 12 included in the perspective view. Dies 118 and 120 establish positioning slot 124 required to prevent previously deformed Section 5 from being drawn between dies 118 and 122 when pressed together to form Section 6 of clown cutter 10.

The positioning slot 124 receives restraining portion 126 of Section 5 of strip 12. A straight portion 128 of strip 12 protrudes longitudinally beyond side wall 130 of die 118. Straight portion 128 must be bent in the direction of arrow 132 while keeping second edge 28 of strip 12 in the same plane with lower planar surface 134 of die 118 until the strip 12 contacts the pressing wall 136 of die 118. Die 122 is then pressed against die 118, thereby forming Section 6 of clown cutter 10. The size of positioning slot 124 required to restrain Section 5 of strip 12 is approximately three and one-half (3½) inches.

Referring to FIGS. 33 through 36, perspective and elevation views of dies 138, 140 and 142 utilized to form Section 7 (see FIG. 2A) of the clown cutter 10 are depicted with strip 12 included in the perspective view. Dies 138 and 140 establish positioning slot 144 required to prevent previously deformed Section 6 from being drawn between dies 138 and 122 when pressed together to form Section 7 of clown cutter 10.

The positioning slot 144 receives restraining portion 146 of Section 6 of strip 12. A straight portion 148 of strip 12 protrudes longitudinally beyond side wall 150 of die 138. Straight portion 148 must be bent in the direction of arrow 152 while keeping second edge 28 of strip 12 in the same plane with lower planar surface 154 of die 138 until the strip 12 contacts the pressing wall 156 of die 138. Die 142 is then pressed against die 138, thereby forming Section 7 of clown cutter 10. The size of positioning slot 144 required to restrain Section 6 of strip 12 is approximately four (4) inches.

Securing the end portions of the strip 12 and the handle 14 to the strip 12, as discussed supra, are the only remaining steps to the fabrication of the clown cutter 10. Using the same teachings and principles of fabrication discussed herein, any required configuration or character can be manufactured.

Obviously, many modifications and variations of the present invention are possible in light of the above teachings. Thus, it is to be understood that within the scope of the appended claims, the invention may be practiced otherwise than as specifically described above.

What is claimed and desired to be secured by Letters Patent of the United States is:

1. A method for manufacturing a bakery cutting device comprising the steps of:

selecting a configuration for the device;

dimensioning said configuration;

selecting a deformable metal strip;

configuring a plurality of dies to deform pre-selected portions of said metal strip;

securing together opposing ends of said metal strip after all portions of said metal strip have been deformed;

attaching handle means to a pre-determined portion of said metal strip; and providing a positioning slot to prevent deformed portions of said metal strip from being drawn between dies that deform a straight portion of said metal strip that is adjacent to said deformed portion.

2. A method for manufacturing a bakery cutting device comprising the steps of:

selecting a configuration for the device;

dimensioning said configuration;

selecting a deformable metal strip;

configuring a plurality of dies to deform pre-selected portions of said metal strip;

securing together opposing ends of said metal strip after all portions of said metal strip have been deformed;

attaching handle means to a pre-determined portion of said metal strip; and locking said opposing ends together by utilizing a punch lock device.

* * * * *